US005570772A

United States Patent [19]

Takemoto et al.

[11] Patent Number: 5,570,772

[45] Date of Patent: Nov. 5, 1996

[54] ASSEMBLY FOR ATTACHING A COIN SEPARATOR

[75] Inventors: Takatoshi Takemoto, Tokyo; Sakuji Yaegasi; Tsutomu Onodera, both of Hanamaki, all of Japan

[73] Assignee: Kabushiki Kaisha Ace Denken, Japan

[21] Appl. No.: 397,669

[22] Filed: Mar. 2, 1995

[30] Foreign Application Priority Data

Mar. 3, 1994 [JP] Japan ..... 6-033890

[51] Int. Cl.[6] ..... G07F 1/04; G07F 9/10

[52] U.S. Cl. ..... 194/344; 194/350

[58] Field of Search ..... 194/317, 318, 194/344, 345, 346, 350; 453/5, 9; 232/7, 14

[56] References Cited

U.S. PATENT DOCUMENTS

| | | | |
|---|---|---|---|
| 3,907,088 | 9/1975 | Burzen | 194/346 X |
| 4,286,703 | 9/1981 | Schuller et al. | 453/9 X |
| 4,374,557 | 2/1983 | Sugimoto et al. | 194/346 X |
| 5,048,663 | 9/1991 | Abe | 194/317 |
| 5,154,272 | 10/1992 | Nishiumi et al. | 194/318 |
| 5,165,511 | 11/1992 | Regidor | 194/350 X |
| 5,449,058 | 9/1995 | Kotler et al. | 194/344 |

*Primary Examiner*—Karen Merritt
*Assistant Examiner*—Scott L. Lowe
*Attorney, Agent, or Firm*—Andrus, Sceales, Starke & Sawall

[57] ABSTRACT

An assembly for attaching a coin separator to a coin stacker, wherein the coin stacker has a plurality of coin storage boxes for storing coins therein, and the coin separator assorts the plurality of sorts of coins supplied from outside and then delivers the assorted coins to the corresponding coin storage boxes. The assembly capable of attaching the coin separator to the coin stacker with ease comprises a main frame which is fixed to the coin stacker; a subframe which is movably coupled to the main frame, which holds the coin separator so as to be detachable, and which guides the coin separator between an engagement position where the coin separator and part of the coin stacker are held in engagement and a non-engagement position where they are not held in engagement; and a fixing member which fixes the coin separator and the subframe to the main frame at the engagement position.

2 Claims, 5 Drawing Sheets

ASSEMBLY FOR ATTACHING A COIN SEPARATOR

BACKGROUND OF THE INVENTION

1. Field of the Invention

The present invention relates to an assembly for attaching a coin separator to a coin stacker. More particularly, it relates to an attaching assembly which facilitates the attachment and detachment of the coin separator to and from the coin stacker.

2. Description of the Related Art

A coin stacker for assorting coins and stacking the assorted coins has been generally known. Usually, a coin separator for assorting the coins (value-X coins and value-Y coins which are respectively exemplified by a 100-yen coin and a 500-yen coin in the Japanese currency) is attached to such a coin stacker. As illustrated in FIG. 7 of the accompanying drawings, the coin separator in the prior art has an assortment passage 1 which is formed with a drop hole for allowing the dropping of only the coin of smaller diameter (for example, the 100-yen coin), a smaller-diameter coin passage 2 which is connected to the drop hole of the assortment passage 1 so as to transport or deliver the smaller-diameter coin to a predetermined coin holding box, and larger-diameter coin passages 3 and 4 which are connected to the trailing end or inner end of the assortment passage 1 so as to transport the coins of larger diameter (for example, the 500-yen coins) to predetermined coin holding boxes. In the example depicted in FIG. 7, the larger-diameter coins can be switchably transported into the two kinds of coin holding boxes (for money changing or money collecting, by way of example). The switching is effected by a flapper 5, and a solenoid actuator 6 and a connecting link 7 which serve to drive the flapper 5. In addition, sensors 8 and 9 for detecting the passing of the corresponding sorts of coins are respectively disposed at the trailing end parts of the smaller-diameter coin passage 2 and the assortment passage 1. The sensors 8 and 9 are capable of detecting the coins.

The coin separator of this type is mounted and used in the state in which the entrance portion 1*a* of the assortment passage 1 is fitted in the coin acceptance portion of the coin stacker, and in which the predetermined coin holding boxes are connected to the respective ejection passages 2, 3 and 4.

The attaching assembly for the coin separator in the prior art, however, has a structure in which the coin separator is merely fixed at its mounting position to the coin stacker by a plurality of screws.

With such an attaching assembly as in the prior art, the attachment of the coin separator necessitates the troublesome operations that the entrance portion 1*a* is fitted in at the predetermined position without any guide means beforehand, and that, while the coin separator held with one hand is being located to the predetermined mounting position, the plurality of screws are driven with the other hand. Also, the detachment of the coin separator necessitates similar troublesome operations in the reverse order. Regarding the coin separator of this type, dust etc. is liable to adhere to the assortment passage 1, and drawbacks such as inability to assort the coins and clogging with coins might occur due to the dust etc. Accordingly, the coin separator needs to be detached and cleaned on occasion. It has therefore been eagerly desired to facilitate the attaching and detaching operations.

SUMMARY OF THE INVENTION

The present invention has been made in view of the problems of the prior art as stated above, and has its object to provide an assembly for attaching a coin separator which facilitates the operations of attaching and detaching the coin separator.

In one aspect of performance of the present invention for accomplishing the object, an assembly for attaching a coin separator to a coin stacker, wherein the coin stacker has a plurality of coin storage boxes for storing coins therein, and the coin separator assorts the plurality of coins inserted from outside and then delivers the assorted coins to the corresponding coin storage boxes; is characterized in that:

the coin separator is to be held in engagement with, at least, part of the coin stacker in order to perform the assortment of the plurality of coins and the delivery of the assorted coins; and in that the attaching assembly comprises:

a main frame which is fixed to the coin stacker;

a subframe which is movably coupled to the main frame, which holds the coin separator so as to be detachable, and which guides the held coin separator between an engagement position where the coin separator and the part of the coin stacker are held in engagement and a non-engagement position where they are not held in engagement; and a fixing member which fixes the coin separator and the subframe to the main frame at the engagement position.

According to the attaching assembly, the coin separator fastened to the subframe at the non-engagement position is guided to the engagement position by the use of this subframe, and it is thereafter fixed at the engagement position by the use of the fixing member. On the other hand, when the fixation of the fixing member is released, the coin separator is guided to the non-engagement position by the use of the subframe. The coin separator is unfastened from the subframe at the non-engagement position.

DETAILED DESCRIPTION OF THE PREFERRED EMBODIMENT

Now, an embodiment of the present invention will be described in conjunction with FIGS. 1 thru 6.

This embodiment exemplifies the application of the present invention to a coin stacker for value-X coins (smaller-diameter coins, for example, 100-yen coins in the Japanese currency) and value-Y coins (larger-diameter coins, for example, 500-yen coins in the Japanese) as is installed in the "game play island" of "pachinko game machines".

"Pachinko" is a Japanese upright pinball game. The "pachinko game machine" has a panel board on which a plurality of pins for guiding each metal ball, called "pachinko ball" are erected, a glass pane which covers the panel board at a predetermined spacing therefrom, and a projection mechanism which throws the pachinko balls into an interspace defined between the panel board and the glass pane. The panel board is formed with a plurality of prize-winning holes which the thrown pachinko balls can enter. Thus, the pachinko game machine dispenses a predetermined numbers of pachinko balls to a game player in accordance with the number of pachinko balls having entered the individual prize-winning holes, whereby the game proceeds. Each "game play island" is an equipment for furnishing a game parlor with the plurality of pachinko game machines which are lined up.

Figure 1:
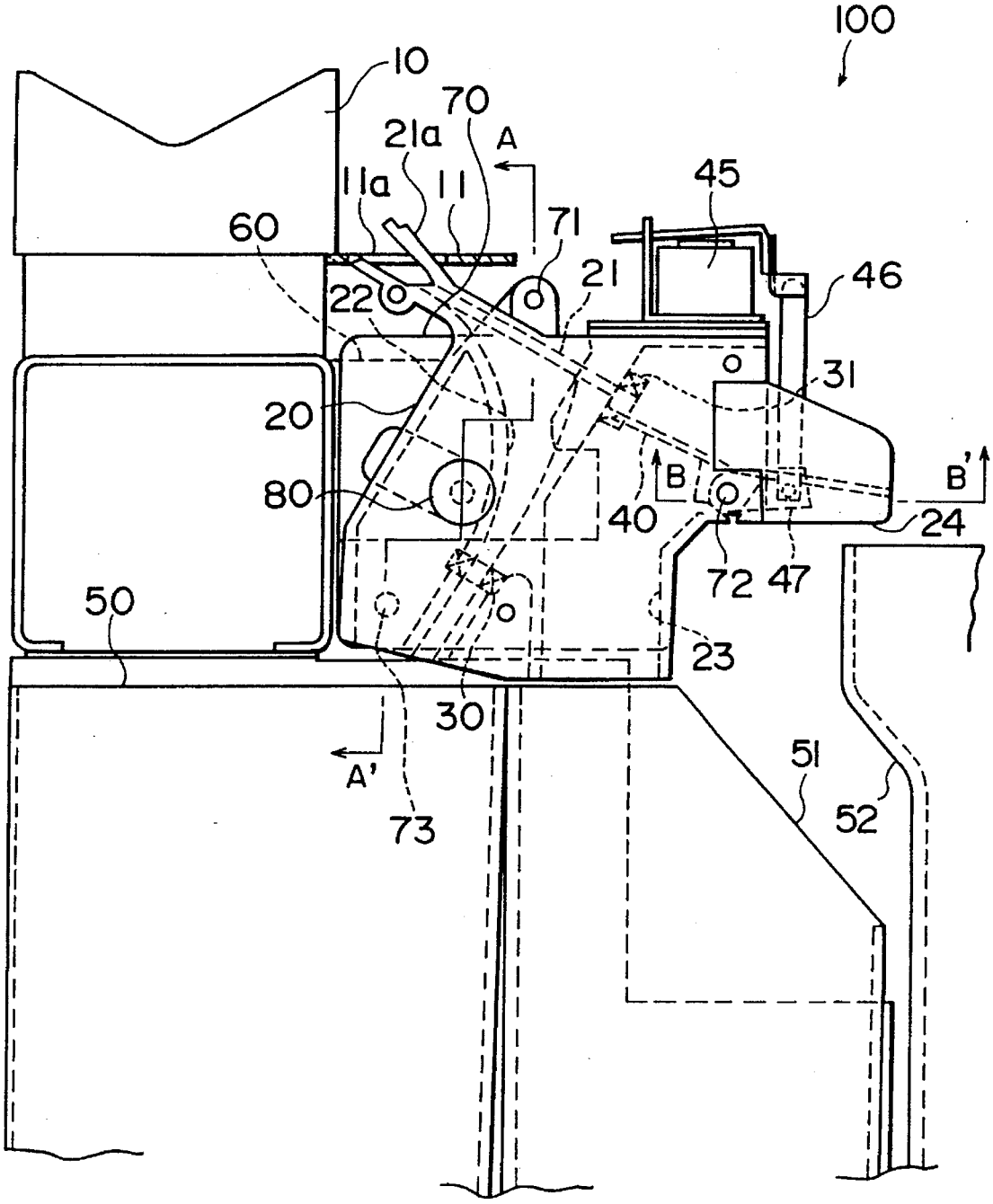
FIG. 1 is a side view, partially broken away, showing the state of a coin stacker in which a coin separator is mounted in an embodiment of the present invention.

As shown in FIG. 1, a coin stacker 100 in this embodiment has a coin mixer 10 as a coin acceptance portion, a coin separator 20, sensors 30 and 31 for reckoning the coins, a flapper 40, and coin holding boxes 50, 51 and 52. As an assembly for attaching the coin separator 20, the coin stacker 100 is further equipped with a main frame 60 (a frame provided on the side of the coin stacker 100), a subframe 70 and a thumb bolt 80.

The value-X and value-Y coins inserted into a "ball lending machine" (a machine for lending out pachinko balls to a game player) in the game play island are carried into the coin mixer 10 by a belt conveyor or the like, not shown. They are ejected through a tongue 11 with which the coin mixer 10 is provided.

Figure 4:
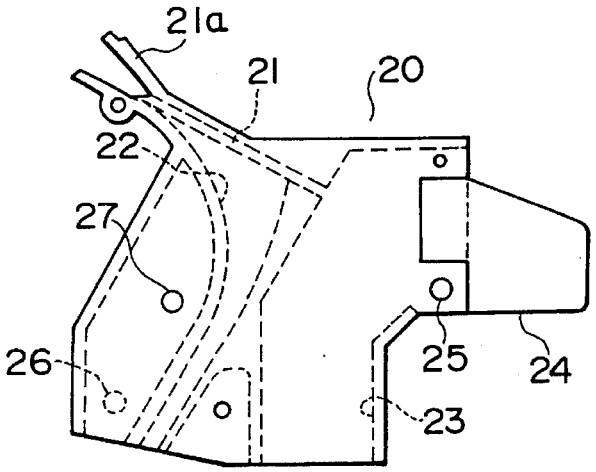
FIG. 4 is a side view showing the coin separator in the embodiment of the present invention.

As shown in FIG. 4, the coin separator 20 includes an assortment passage 21 which is formed with a drop hole (not shown) for dropping only the value-X coin (smaller-diameter coin), a smaller-diameter coin passage 22 which is connected to the drop hole of the assortment passage 21 so as to transport or deliver the value-X coins to the coin holding box 50 (depicted in FIG. 1), and larger-diameter coin passages 23 and 24 which are both connected to the trailing end of the assortment passage 21 so as to transport or deliver the value-Y coins (larger-diameter coins) to the coin holding boxes 51 and 52 (depicted in FIG. 1), respectively. A port 21*a* for accepting the value-X and value-Y coins is formed at the leading end or outer end of the assortment passage 21. Apertures 25 and 26 into which guide posts 72 and 73 to be explained later are respectively fitted, and an aperture 27 through which the thumb bolt 80 is inserted, are formed at predetermined positions in the side walls of the coin separator 20.

Figure 2:
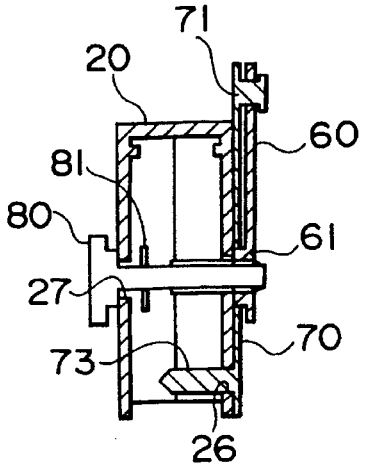
FIG. 2 is a sectional view taken along plane A–A' indicated in FIG. 1.

As clearly shown in FIG. 2, the coin separator 20 has a two-piece structure which is divided in two in the thickness direction thereof. Both the pieces of the coin separator 20 are clamped by the thumb bolt 80 into the unitary structure. Besides, as can be seen from FIG. 1, the coin separator 20 is mounted on the coin stacker 100 in the state in which, in order to prevent the coins from overflowing and falling, the coin acceptance port 21*a* is inserted into a coin ejection port 11*a* formed in the tongue 11, thereby connecting the smaller-diameter coin passage 22 to the coin holding box 50, the larger-diameter coin passage 23 to the coin holding box 51 and the larger-diameter coin passage 24 to the coin holding box 52. This state of the coin separator 20 corresponds to the mounting position thereof. Further, the inner side wall of the coin separator 20 has a shape in which it is largely cut away so as not to interfere with any of the sensors 30 and 31 and the flapper 40 in attaching and detaching this coin separator to and from the subframe 70.

Figure 6:
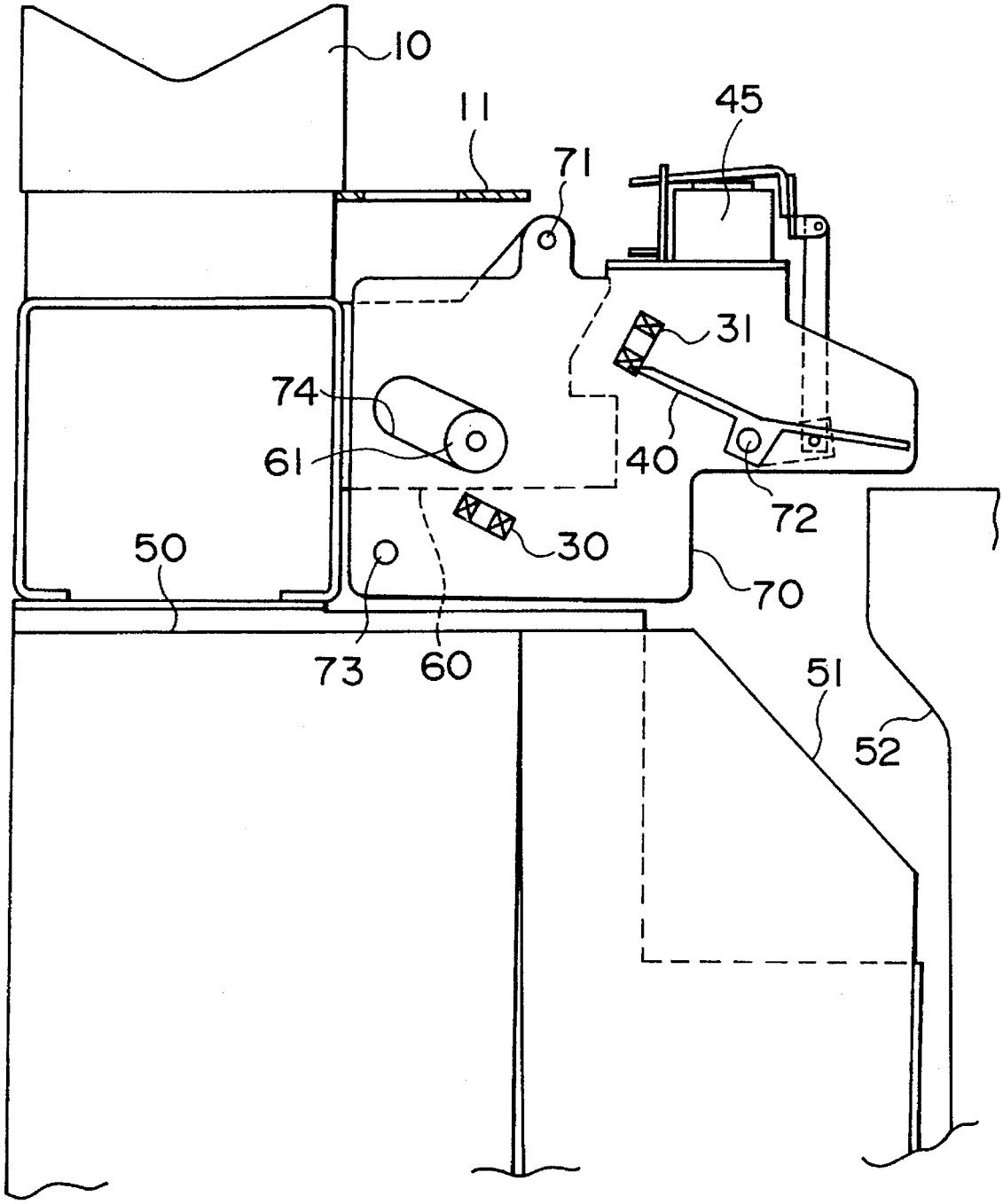
FIG. 6 is a side view, partially broken away, showing the state of the coin stacker in which the coin separator is dismounted in the embodiment of the present invention.
Figure 7:
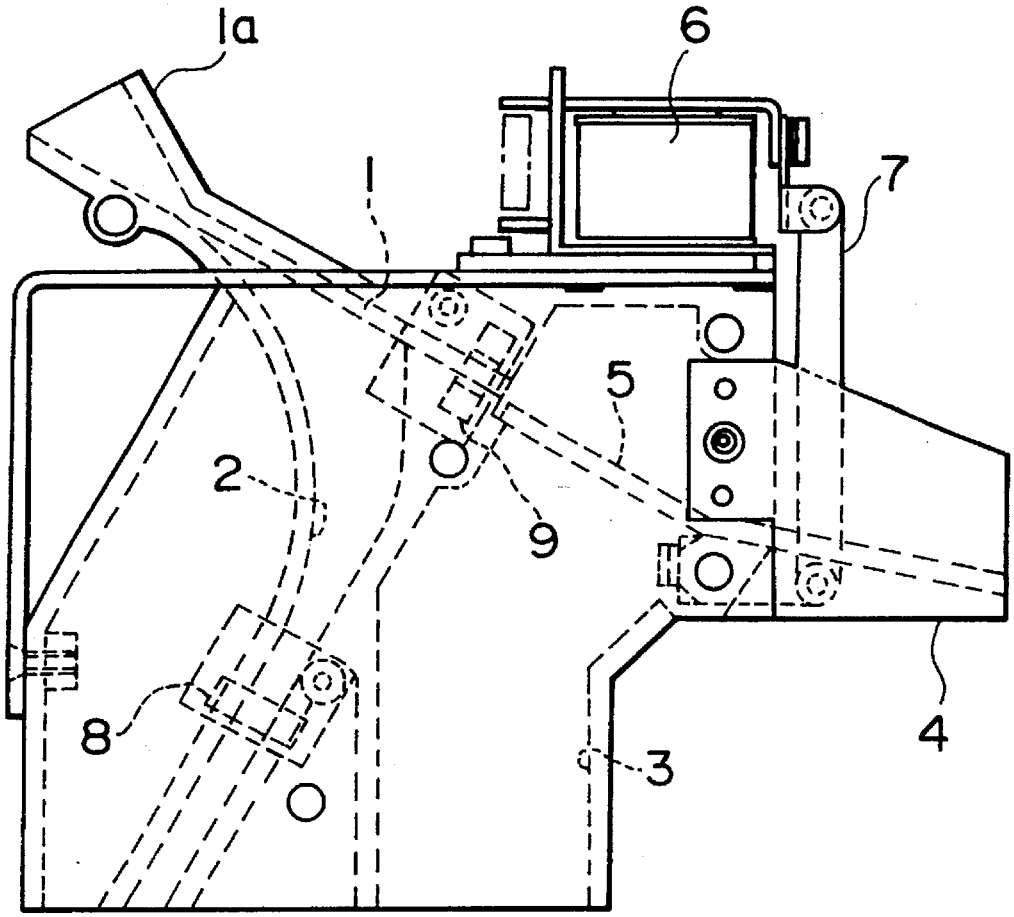
FIG. 7 PRIOR ART
FIG. 7 is a side view showing a coin separator in the prior art.

Each of the sensors 30 and 31 can be implemented by, for example, a photosensor which is configured of a light emitting element and a light receiving element. The sensors 30 and 31 are fixed to the subframe 70 as shown in FIG. 6. These sensors 30 and 31 are arranged so as to lie in the predetermined passages (the passage 22 and the passages 23, 24, respectively) when the coin separator 20 has been attached to the subframe 70.

Figure 3:
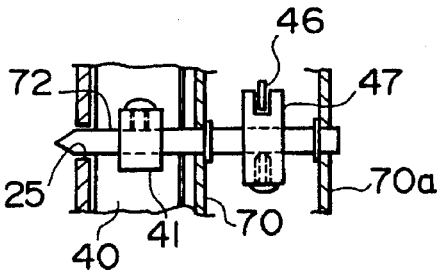
FIG. 3 is a sectional view taken along plane B–B' indicated in FIG. 1.

The flapper 40 is in the shape of a band which is positioned opposite to the inner side surfaces with slight gaps therefrom. The flapper 40 is arranged so that one end lies near the trailing end of the assortment passage 21 of the coin separator 20, and the other end lies over the upper opening of the coin holding box 52. As shown in FIG. 3, the flapper 40 is fixed to the guide post 72 by screwing a boss member 41 to this guide post. Thus, the flapper 40 can be rocked along the inner side surfaces of the coin separator 20 by the guide post 72.

Herein, the flapper 40 is driven together with the guide post 72 by a solenoid actuator 45 which is attached to the subframe 70 on the rear side of the coin separator 20 (on the opposite side as viewed in FIG. 1), and links 46 and 47 which transmit the driving force of the solenoid actuator 45 as the turning force of the guide post 72. When driven, the flapper 40 is rocked between a position at which one end lies below the trailing end of the assortment passage 21 and a position at which it lies above the same.

Among the coin holding boxes 50, 51 and 52, the box 50 serves to collect the value-X coins (smaller-diameter coins), the box 51 serves to collect the value-Y coins (larger-diameter coins), and the box 52 serves to stock the value-Y coins for money changing. Incidentally, the value-Y coins stocked in the coin holding box 52 are occasionally delivered out by an unshown delivery means, and they are utilized as coins which are dispensed for money changing by a money changer installed in the game play island.

The main frame 60 is fixed to the frame of the coin mixer 10. This main frame 60 has a plate-like flat portion which extends along the inner side surface of the coin separator 20 lying at the mounting position. As shown in FIG. 2 or FIG. 6, the flat portion of the main frame 60 is formed with a boss 61. The boss 61 is slightly protruded toward the coin separator 20, and the inner peripheral surface thereof is threaded in order to bring the thumb bolt 80 into threadable engagement therewith.

The subframe 70 is rockably fastened to the flat portion of the main frame 60 by a supporting arbor 71. Besides, the subframe 70 forms part of the side wall of the coin separator 20 in attaching this coin separator. The inner side wall of the subframe 70 is provided with the guide posts 72 and 73 being pin-like members which are parallel to the supporting arbor 71. The guide posts 72 and 73 are snugly fitted in the apertures 25 and 26, respectively, whereby the coin separator 20 is attached to the subframe 70.

By the way, as shown in FIG. 3, the subframe 70 is formed with a plate-like flat portion 70a which extends in an inverted-L shape from the upper part of this subframe. The solenoid actuator 45 is fixed on the upper surface of the flat portion 70a. In addition, the guide post 73 is formed to be integral with the subframe 70. On the other hand, as shown in FIG. 3, the guide post 72 is supported so as to be slidingly turnable by the side wall and the flat portion 70*a* of the subframe 70, and it functions also as a turning shaft for the flapper 40.

The position at which the supporting arbor 71 is fastened to the main frame 60, is set so that the coin separator 20 can be rocked together with the subframe 70 between its mounting position stated before and its non-interfering position at which it can be attached and detached without interfering with any of the tongue 11, etc. As shown in FIG. 6, the subframe 70 is formed with a guide slit 74 which serves to guide the rocking of the subframe 70 at a predetermined angle in sliding contact with the boss 61.

As shown in FIG. 2, the thumb bolt 80 has its shank inserted through the aperture 27 of the coin separator 20. A retaining ring 81 disposed inside the coin separator 20 is fitted round the shank of the thumb bolt 80. Thus, the thumb bolt 80 is axially slid to a screwed extent in the retaining ring 81. By the way, the fastening position of the thumb bolt 80, in other words, the position of the aperture 27 of the coin separator 20 is set so as to just become coaxial with the boss 61 of the main frame 60 when the coin separator 20 lies at its mounting position.

Next, the operation of this embodiment will be described.

In the coin stacker 100, the coins ejected from the coin mixer 10 enter the coin separator 20 through the coin acceptance port 21*a* and are assorted by the assortment passage 21. Then, the value-X coins (smaller-diameter coins) drop through the drop hole of the assortment passage 21 into the smaller-diameter coin passage 22 and pass through this passage 22 into the coin holding box 50. On the other hand, the value-Y coins (larger-diameter coins) proceed beyond the drop hole of the assortment passage 21 and pass through this passage 21. They are thereafter transported selectively into the coin holding box 51 when one end of the flapper 40 near the assortment passage 21 lies above the trailing end of the assortment passage, or into the coin holding box 52 when the aforementioned end lies below the trailing end of the assortment passage.

Figure 5:
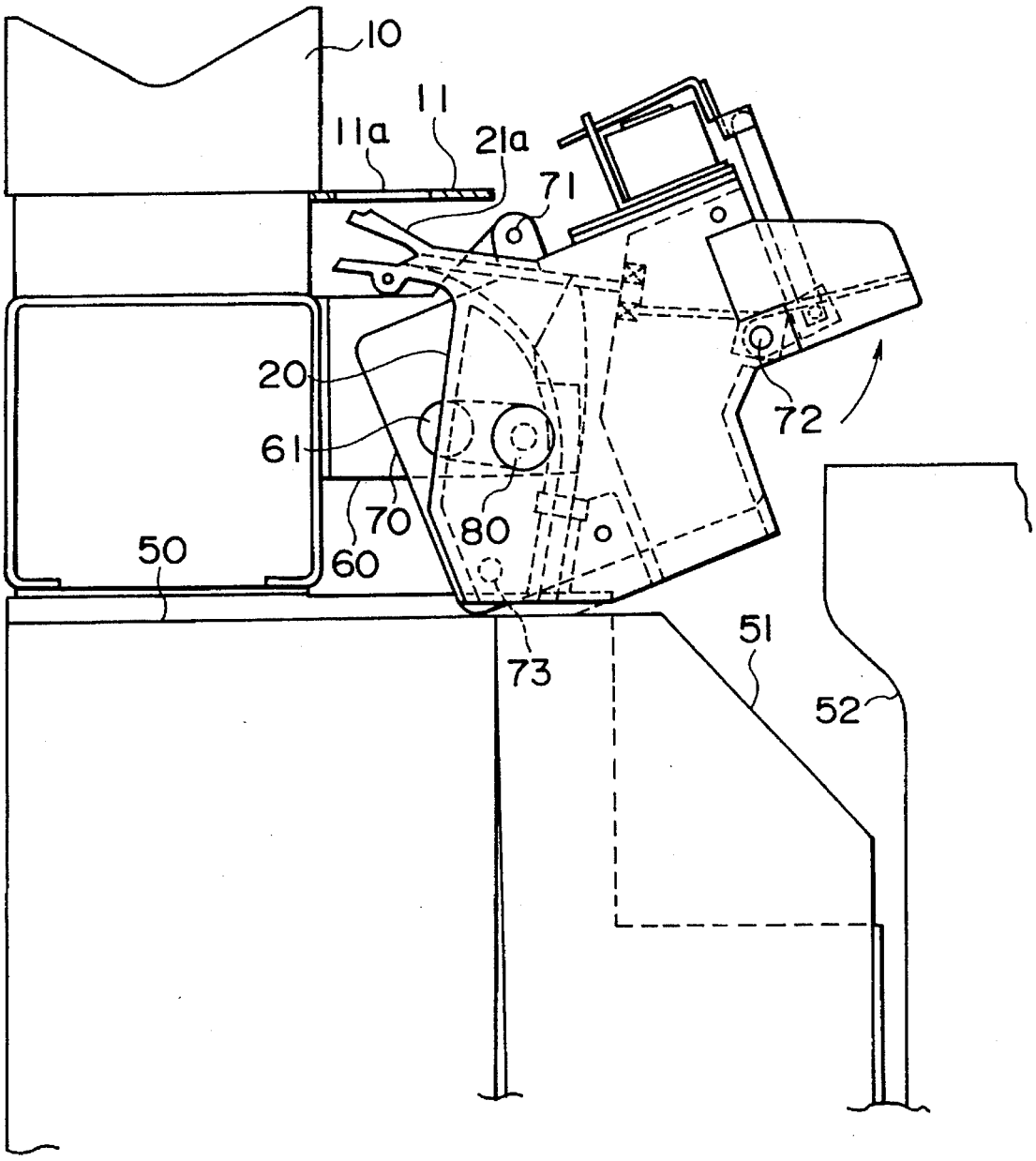
FIG. 5 is a side view, partially broken away, for explaining the operations of attaching and detaching the coin separator to and from the coin stacker in the embodiment of the present invention.

The detachment of the coin separator 20 from the coin stacker 100 can be easily and smoothly made by simple operations as stated below. First, the thumb bolt 80 is threadably loosened by the hand to be pulled out of the boss 61 of the main frame 60. Subsequently, the subframe 70 is rocked as shown in FIG. 5 until the coin separator 20 is moved to the non-interfering position at which the coin acceptance port 21*a* comes off the coin ejection port 11*a*. In such a state, the coin separator 20 is drawn out this side as viewed in FIG. 5, thereby bringing both the guide posts 72 and 73 out of fit engagement. Then, only the body of the coin separator 20 can be detached from the subframe 70 with the sensors 30 and 31 and the flapper 40 left on this subframe as shown in FIG. 6.

Conversely, the attachment of the coin separator 20 to the coin stacker 100 can be easily and smoothly made by the reverse order of procedure as stated below. First, the sub frame 70 is moved to its position which corresponds to the non-interfering position of the coin separator 20. Subsequently, the guide posts 72 and 73 are respectively fitted into the apertures 25 and 26 of the coin separator 20, thereby attaching the coin separator 20 to the subframe 70. Upon completion of the attachment, the subframe 70 is rocked about the supporting arbor 71 until the coin separator 20 is moved reliably to its mounting position depicted in FIG. 1. Thereafter, the thumb bolt 80 may be screwed into the boss 61 of the main frame 60 so as to clamp the subframe 70 and the coin separator 20 to the main frame 60.

Accordingly, the assembly for attaching the coin separator 20 in this embodiment can render the cleaning etc. of this coin separator much easier. Especially, according to this embodiment, only the body of the coin separator 20 can be detached with the sensors 30 and 31 and the solenoid actuator 45 left on the subframe 70, so that the disposal of electric wire pieces connected to these electric devices need not be considered. Such effects are remarkable.

What is claimed is:

1. An assembly for attaching a coin separator to a coin ejector, said coin ejector having a coin ejection port for ejecting a plurality of different sized of coins therefrom, the coin separator sorting the plurality of coins ejected from the coin ejection port by size and delivering the sorted coins to coin storage devices, said coin separator having one side that is largely cut away, said coin separator being formed with a coin reception portion that is couplable to said coin ejection port of said coin ejector for receiving the plurality of coins ejected from said coin ejection port, said attaching assembly comprising:

a mainframe (60) provided on the coin ejector;

a subframe (70) which is rotatably fastened to said mainframe, said subframe detachably mounting said coin separator (20), said coin separator being mounted on said subframe with said one side adjacent said subframe so that said subframe forms a side wall for said coin separator, said subframe allowing said coin separator, when mounted thereon, to move with respect to said frame in arcuate path between an insertion position in which said coin reception portion of said coin separator is coupled to said coin ejection port of said coin ejector and a non-insertion position in which the former is not coupled to the latter; and a fixing member (80) for fixing said coin separator to both said mainframe and said subframe at the insertion position.

2. An assembly for attaching a coin separator as defined in claim 1, wherein said subframe carries thereon sensors, each of which detects an inserted coin, a flapper which delivers the sorted coins to desired coin storage boxes, and a driver which drives said flapper, said sensors, flapper, and driver being retained on said subframe when said coin separator is detached from said subframe.

* * * * *